US006737137B2

(12) United States Patent
Franko, Sr. et al.

(10) Patent No.: US 6,737,137 B2
(45) Date of Patent: May 18, 2004

(54) ADHESIVE IMAGE TRANSFER LABELS AND METHOD OF MANUFACTURE THEREOF

(75) Inventors: Joseph D. Franko, Sr., Ham Lake, MN (US); Todd C. Wentz, Rogers, MN (US)

(73) Assignee: Quality Assured Enterprises, Inc., Minnetonka, MN (US)

( * ) Notice: Subject to any disclaimer, the term of this patent is extended or adjusted under 35 U.S.C. 154(b) by 0 days.

(21) Appl. No.: 09/899,374

(22) Filed: Jul. 3, 2001

(65) Prior Publication Data

US 2003/0006606 A1 Jan. 9, 2003

(51) Int. Cl.[7] ..... B42D 15/00

(52) U.S. Cl. ..... 428/40.1; 283/81; 283/98; 283/101; 428/41.3; 428/41.7; 428/41.8; 428/42.1; 428/42.2; 428/42.3; 428/201; 428/203; 428/204; 428/914

(58) Field of Search ..... 283/81, 98, 101; 428/354, 40.1, 41.3, 41.7, 41.8, 42.1, 42.2, 42.3, 201, 204, 203, 914

(56) References Cited

U.S. PATENT DOCUMENTS

| | | | | | |
|---|---|---|---|---|---|
| 3,516,842 | A | * | 6/1970 | Klinker | 428/914 |
| 3,922,435 | A | * | 11/1975 | Asnes | 428/349 |
| 4,724,166 | A | | 2/1988 | deBruin | 427/208.8 |
| 4,849,043 | A | | 7/1989 | Instance | |
| 5,031,938 | A | | 7/1991 | Instance | |
| 5,042,842 | A | * | 8/1991 | Green et al. | 283/101 |
| 5,106,124 | A | | 4/1992 | Volkman et al. | |
| 5,264,265 | A | * | 11/1993 | Kaufmann | 283/80 |
| 5,580,640 | A | * | 12/1996 | Kraft et al. | 283/81 |
| 5,866,219 | A | | 2/1999 | McClure et al. | |
| 6,099,943 | A | * | 8/2000 | Moeller | 428/195 |
| 6,179,335 | B1 | | 1/2001 | DeLise, Jr. | |
| 6,228,486 | B1 | * | 5/2001 | Kittel et al. | 428/354 |
| 6,231,082 | B1 | * | 5/2001 | Van Boom et al. | 283/100 |
| 2002/0000718 | A1 | * | 1/2002 | Schwarzbauer | 283/62 |

* cited by examiner

*Primary Examiner*—Nasser Ahmad
(74) *Attorney, Agent, or Firm*—Walter K. Roloff; Charles G. Mersereau

(57) ABSTRACT

An adhesive image transfer label includes a top ply having a front surface and a back surface. The front and back surfaces of the top ply are each capable of bearing printed graphics. A release coating is applied over a selected portion of the back surface of the top ply, and a breakaway coating is applied over the release coating. The breakaway coating, like the front and back surfaces of the top ply, is capable of bearing printed graphics. An adhesive coating is applied in flood coat fashion over the label, over the back surface of the top ply and over the breakaway coating. The label provides low cost and extended text identification and decoration for a product container, as well as a coupon-type label.

13 Claims, 7 Drawing Sheets

ADHESIVE IMAGE TRANSFER LABELS AND METHOD OF MANUFACTURE THEREOF

FIELD OF THE INVENTION

The present invention relates generally to labels. The invention relates specifically to adhesive labels having a re-sealable or detachable portion with an underlying or remaining transfer image, for decoration and identification of product containers.

BACKGROUND OF THE INVENTION

In the printing arts, and in particular in the commercial printed label art for labeling and decorating consumer products, there exists a continual demand for labels and decorations which not only appeal to consumers, but also bear ever increasing amounts of printed information. For example, labels for identification of consumer health care and pharmaceutical products are often required by governmental regulations to describe in painstaking detail their compositions and ingredients. As new food and drug laws are passed, regulations require the inclusion of increasing amounts of label information.

To provide increased printed information on labels, various forms of so-called "extended text" labels have been proposed. One such extended text label type that has gained wide popularity is the booklet type label, where a base ply is joined to a cover ply via an adhesive coupling or "hinge" between the two plies. An example of this type of label is disclosed in U.S. Pat. No. 5,264,265 issued to Kaufmann, entitled "PEEL-BACK RE-SEALABLE MULTI-PLY LABEL".

However, known booklet-type extended text labels are generally more expensive to produce than single ply adhesive labels, due to additional materials costs.

Also, known extended text labels particularly used in labeling consumer health care products are subject to damage by removal of one or more plies, whether by intentional tampering or by physical effects of handling in the marketplace.

Further, these extended text labels are not readily adaptable for use as coupon-type labels. In a typical coupon-type label, a top ply (or other portion of the label) may be removed by a consumer for production of a coupon. The consumer's removal of the coupon portion may result in a loss of product identification, being carried on the removed coupon, from the remaining labeled product container.

Additionally, it is generally accepted and well-known in the label making arts that in-line printing and converting processes offer the most cost-effective label production. An exemplary in-line method is disclosed in U.S. Pat. No. 4,849,043 issued to Instance, entitled "METHOD OF PRODUCING LABELS".

Thus, there exists a need for a label that is inexpensive and simple to produce, that provides extended text labeling without a need for multiple plies, is resistant to damage in terms of retaining product identification, and is readily adaptable for use as a coupon-type label while retaining product identification. There also exists a need for an in-line converting and printing process for manufacture of such labels.

SUMMARY OF THE INVENTION

An object of the present invention is to provide a label that is inexpensive and simple to produce.

Another object of the present invention is to provide a label that is resistant to damage by minimizing a loss of product identification.

Yet another object of the present invention is to provide a label that is readily adaptable for use as a coupon-type label while retaining product identification.

A further object of the present invention is to provide an in-line converting and printing process for manufacture such labels.

In accordance with the present invention, an adhesive image transfer label includes a top ply having a front surface and a back surface. The front and back surfaces of the top ply are each capable of bearing printed graphics. A release coating is applied over a selected portion of the back surface of the top ply, and a breakaway coating is applied over the release coating. The breakaway coating, like the front and back surfaces of the top ply, is capable of bearing printed graphics. An adhesive coating is applied in flood coat fashion over the label, over the back surface of the top ply and over the breakaway coating.

DETAILED DESCRIPTION OF THE INVENTION

Figure 1:
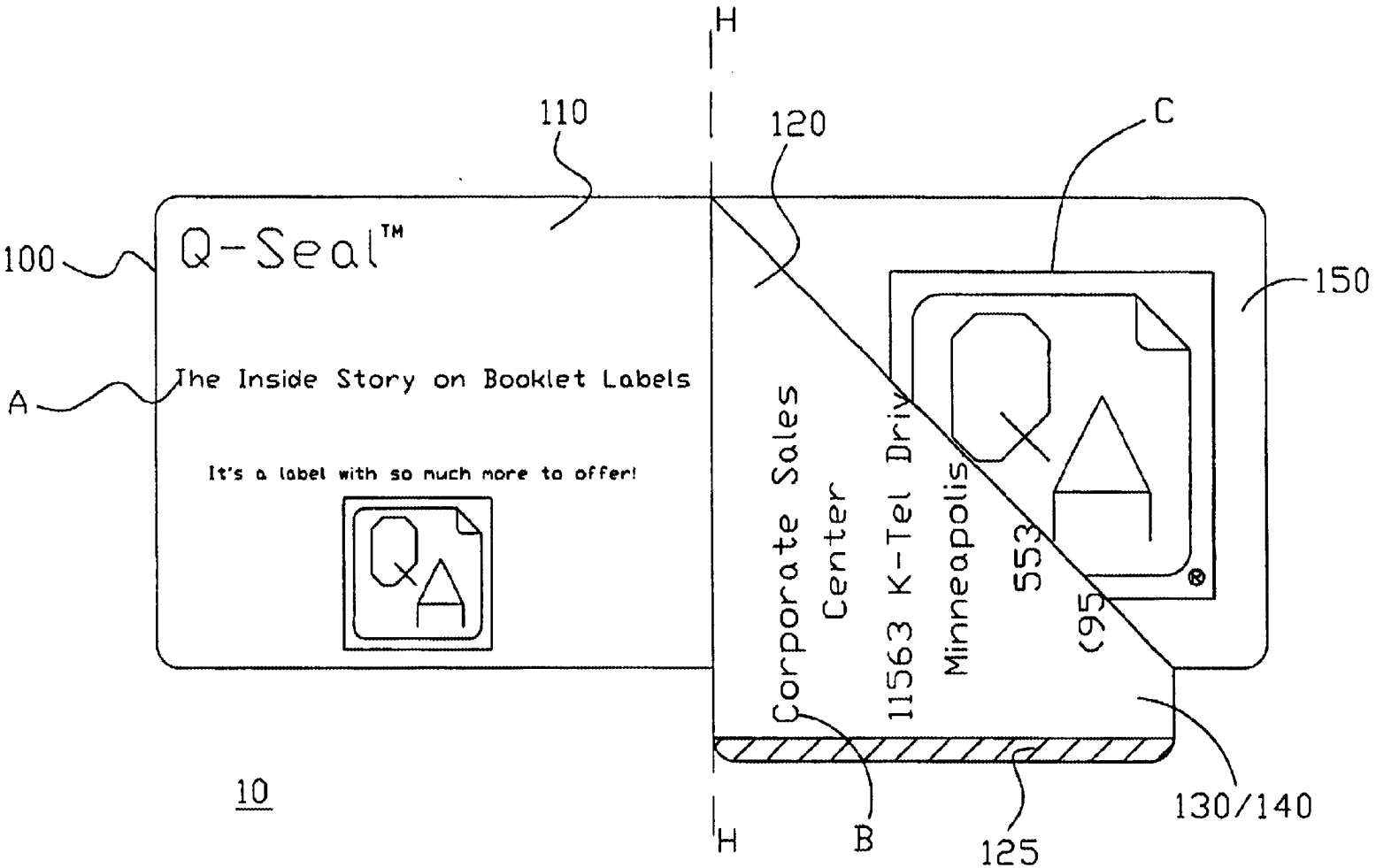
FIG. 1 is a front view illustration of an exemplary adhesive image transfer label constructed in accordance with the present invention.
Figure 1A:
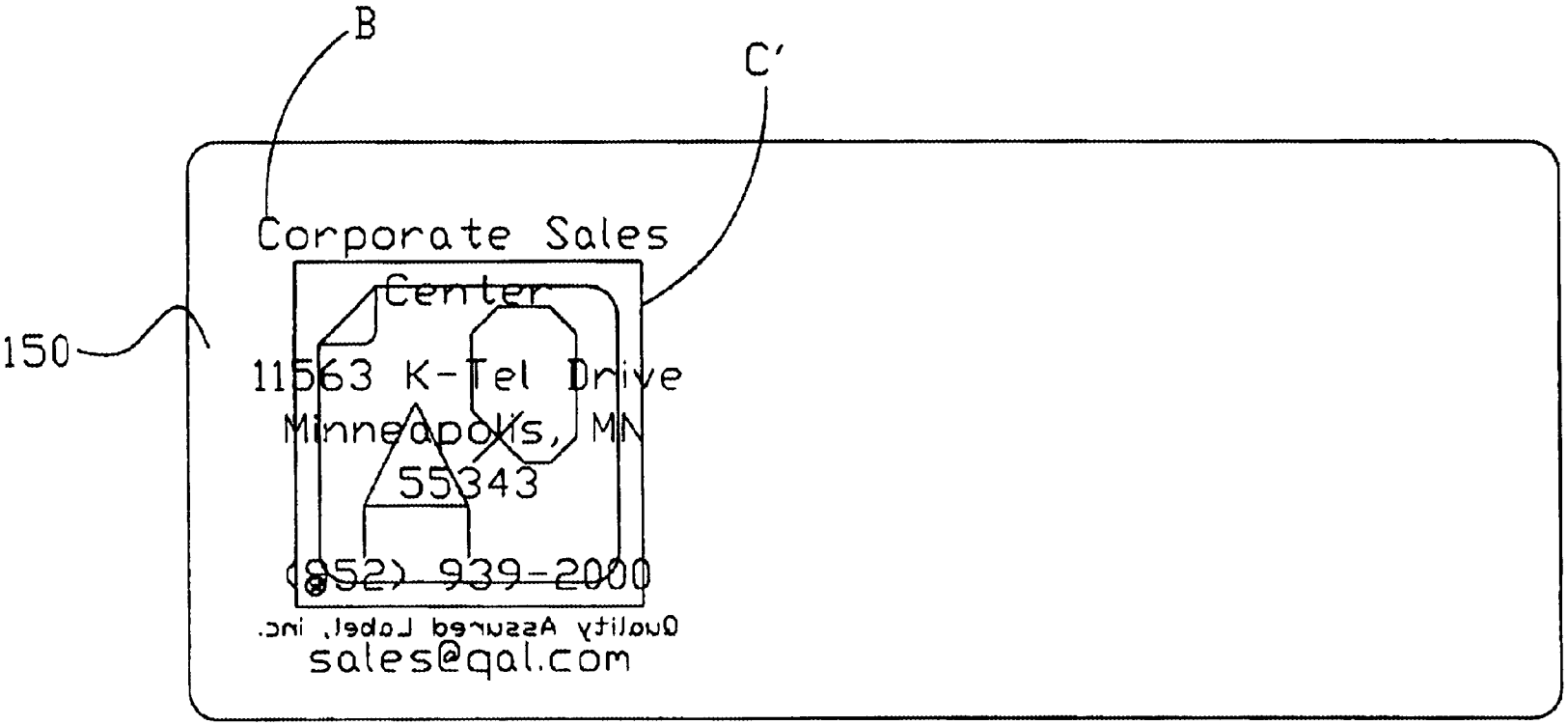
FIG. 1*a* is a back view illustration of the label of FIG. 1.
Figure 2:
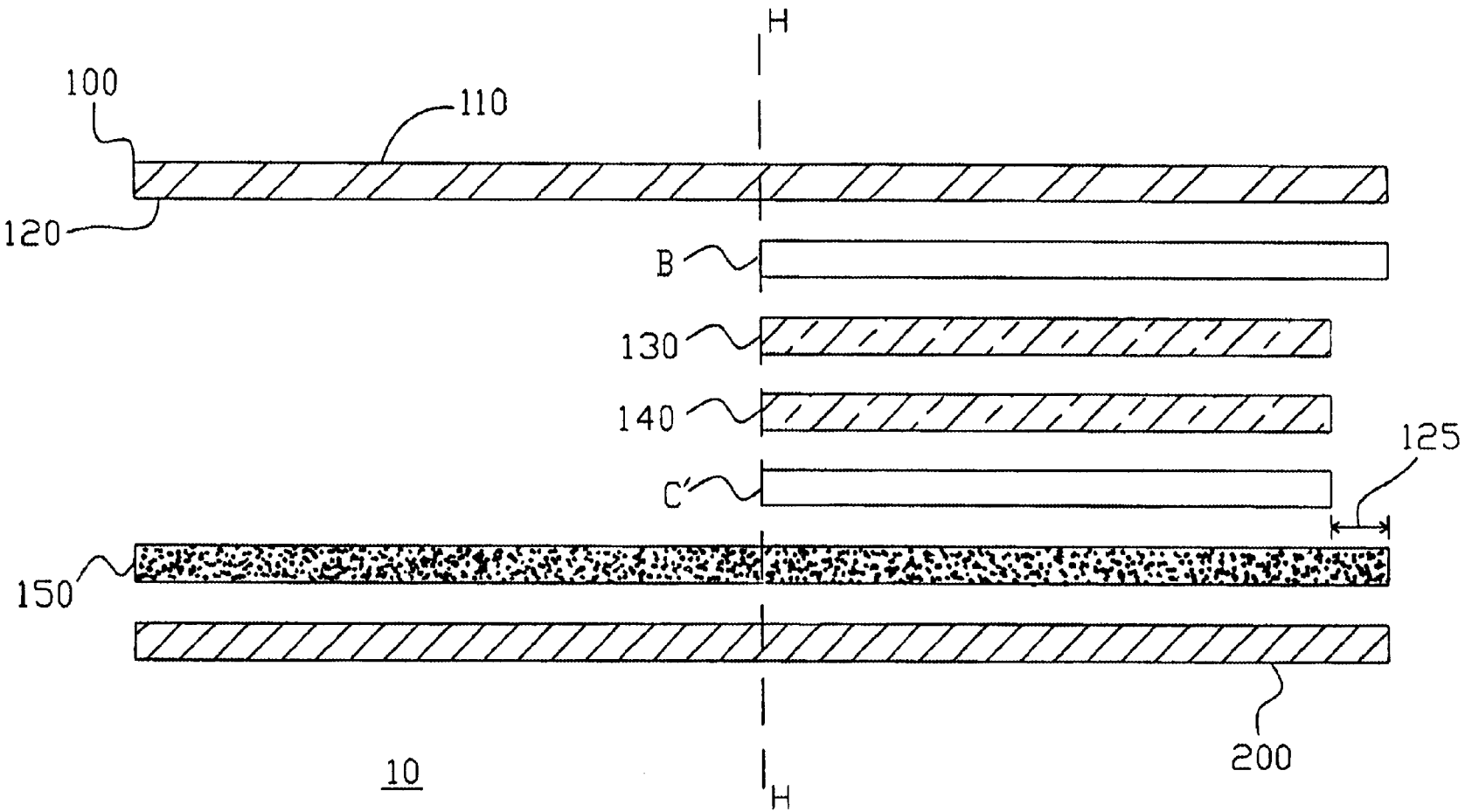
FIG. 2 is a schematic side view representation of the label of FIG. 1.

Referring to FIGS. 1, 1*a*, and 2, there shown are alternative views of an adhesive image transfer label 10. Label 10 includes a top ply 100 having a front surface 110 and a back surface 120, a re-sealable adhesive portion 125, a release coating 130, a clear breakaway coating 140, and an adhesive coating 150.

Top ply 100 is preferably any commercially available web-like material that is capable of use in an in-line printing and converting process (as will be further described relative to manufacture of label 10) such as, for example, paper, polypropylene, polyethylene, polyester, polyvinylchloride, polystyrene, foil, or ethylene vinyl acetate.

Front and back surfaces 110 and 120 of top ply 100 are each capable of bearing printed graphics thereon, as indicated in the figure by reference characters A and B, respectively.

In construction of label 10, release coating 130 is applied to a selected portion of back surface 120 of top ply 100 over printed graphics B, and clear breakaway coating 140 is applied, in turn, over release coating 130. Coatings 130 and 140 are preferably chosen from water-based, solvent-based, ultraviolet light activated, and hot melt coatings as are commercially available Craig Adhesives & Coatings Co. of Newark, N.J., and Northwest Coatings Corp. of Oak Creek, Wis. Coatings 130 and 140 are particularly chosen to cleanly break away from each other in use of label 10 as will be described.

Clear breakaway coating 140, like back surface 120 of top ply 100, is capable of bearing printed graphics thereon. With reference in particular to FIG. 1*a*, a reverse graphics image (reference character C) may be printed on breakaway coating 140, so that in use of label 10 (as will be described) a forward view of reverse image C (indicated by reference character C' in FIG. 1) may be observed.

Finally, in construction of label 10 and as shown particularly in FIG. 2, adhesive coating 150 is provided fully (or "flood coated") over back surface 120 of top ply 100 (including image B) and over breakaway coating 140 (including image C). Adhesive coating 150 is preferably a commercially available transfer adhesive from the Coated Products Operations of Green Bay Packaging Inc. in Green Bay, Wis.

Referring again to FIGS. 1 and 2, it is to be understood as is well known in the art that applications of release coating 130 and breakaway coating 140 to a selected portion of back surface 120 of top ply 100 forms a hinge for top ply 100 about reference axis H—H between top ply 100 and adhesive 150. Additionally, such selected applications of coatings 130 and 140, in combination with the ink of image B acting as a varnish or deadening agent as is well known in the art, provides re-sealable adhesive portion 125 as may be ascertained in FIG. 2. Specifically, the re-sealabilty of re-sealable adhesive portion 125 is attributable to (i) the absence of coatings 130 and 140 from a small strip of back surface 120 of top ply 100, and (ii) the presence of the ink of image B that inhibits adhesive 150 from substantially bonding with back surface 120.

Turning particularly now to FIG. 2, where label 10 is depicted in an exploded schematic side view, a release liner 200 is shown. Release liner 200, as is known generally in the pressure-sensitive label arts, enables label 10 to be produced in an in-line printing and converting process (as will be described with reference to FIG. 4). Release liner 200 is commercially available in roll form for such in-line printing and converting from Rhinelander Paper Company of Rhinelander, Wis.

Figure 2A:
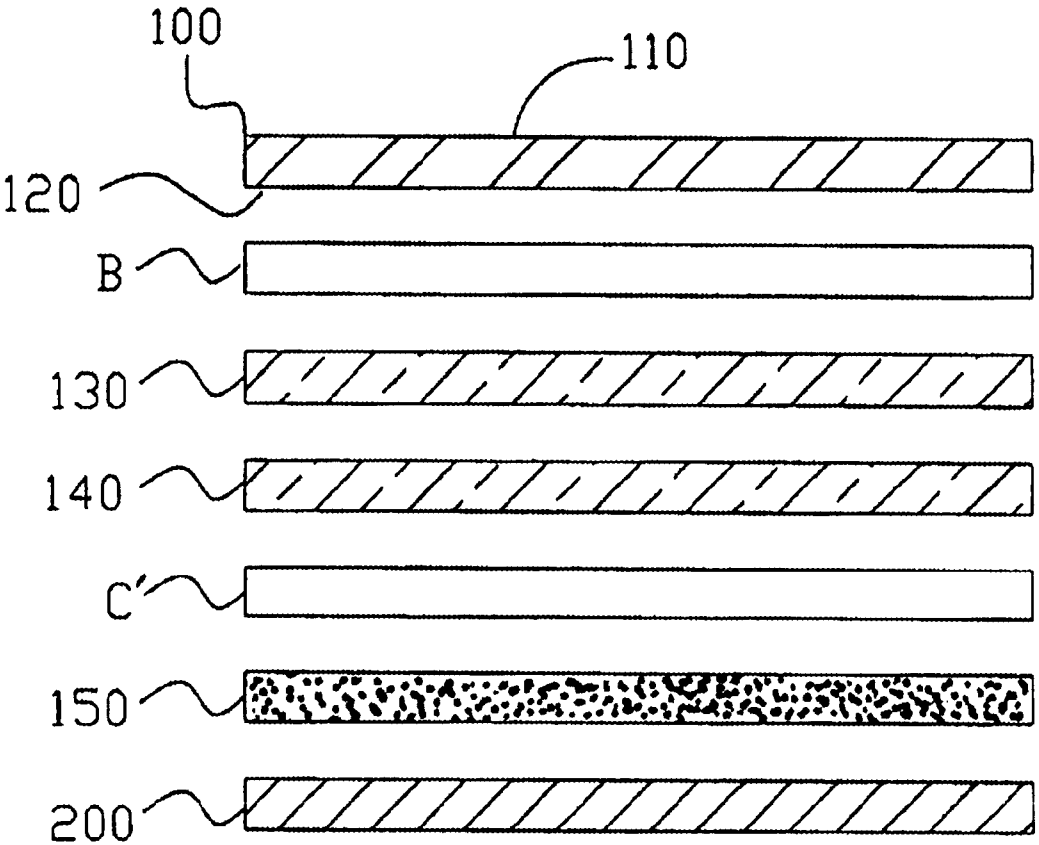
FIG. 2*a* is a schematic side view representation of an adhesive image transfer coupon-type label constructed in accordance with the present invention.

In FIG. 2*a*, label 10 is shown as embodying a coupon-type adhesive image transfer label. In such a coupon-type embodiment, coatings 130 and 140 are applied in flood coat fashion to an entirety of back surface 120 of top ply 100. Thus, top ply 100 is completely removable from label 10, and accordingly forms a coupon. It is to be appreciated in this embodiment that image C would preferably contain identification and/or decoration that is desired to remain upon a container bearing label 10 when top ply 100 is so removed as a coupon.

Figure 3:
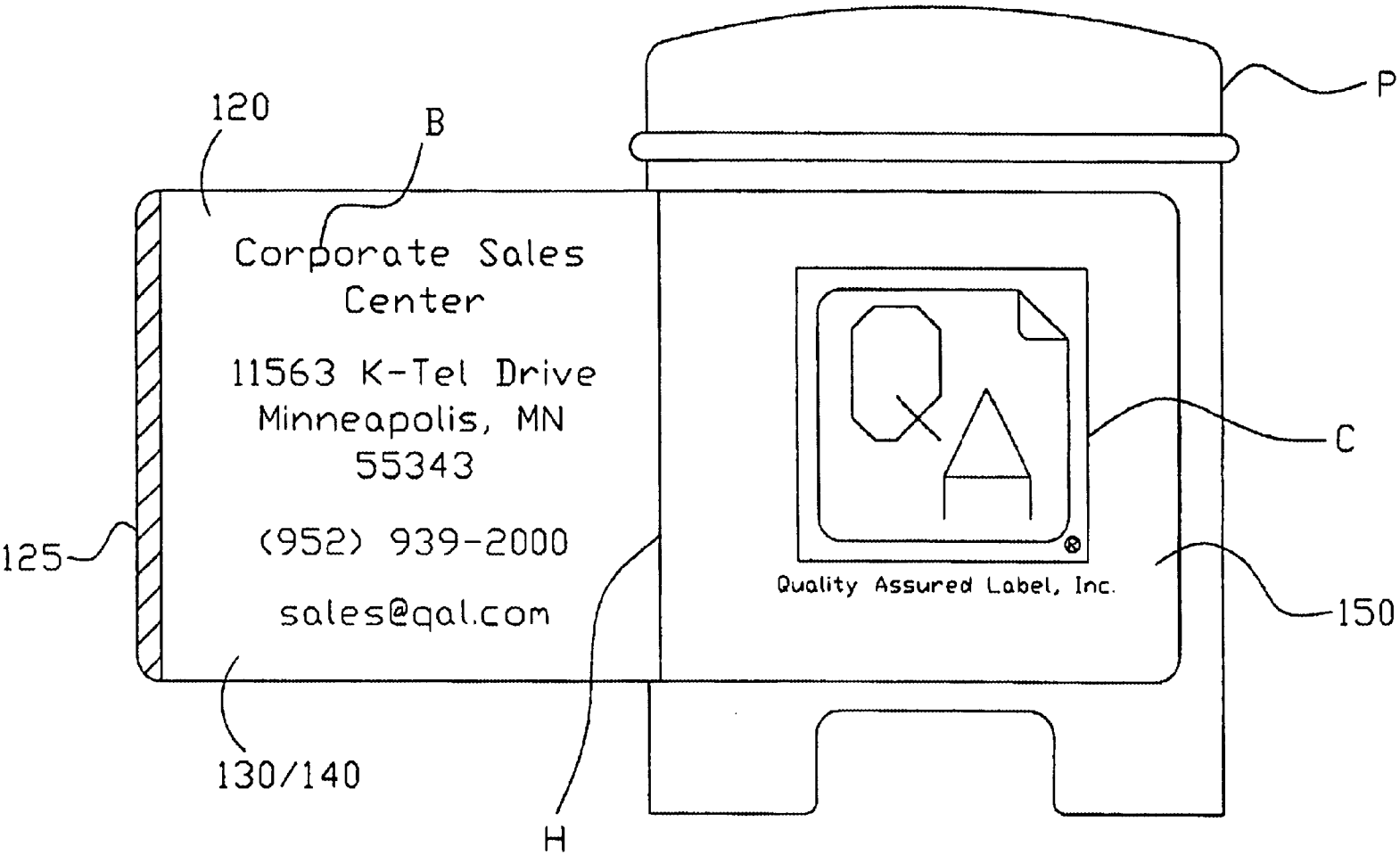
FIG. 3 is a front view illustration of the label of FIG. 1, shown as having been adhered to a product container and in use.

Turning, now, to FIG. 3, label 10 is shown in use as having been applied to a product container P (e.g., a deodorant barrel). Specifically, top ply 100 of label 10 is shown as having been opened by a consumer about hinge line H—H. Upon closing of top ply 100, re-sealable adhesive portion 125 functions to maintain label 10 in a closed state. It is to be appreciated that image C', appearing on adhesive 150 and being visible when top ply 100 is opened, provides product identification and/or decoration without a need for additional film material in label 10, thereby being less costly relative to previously known extended text labels.

Figure 4:
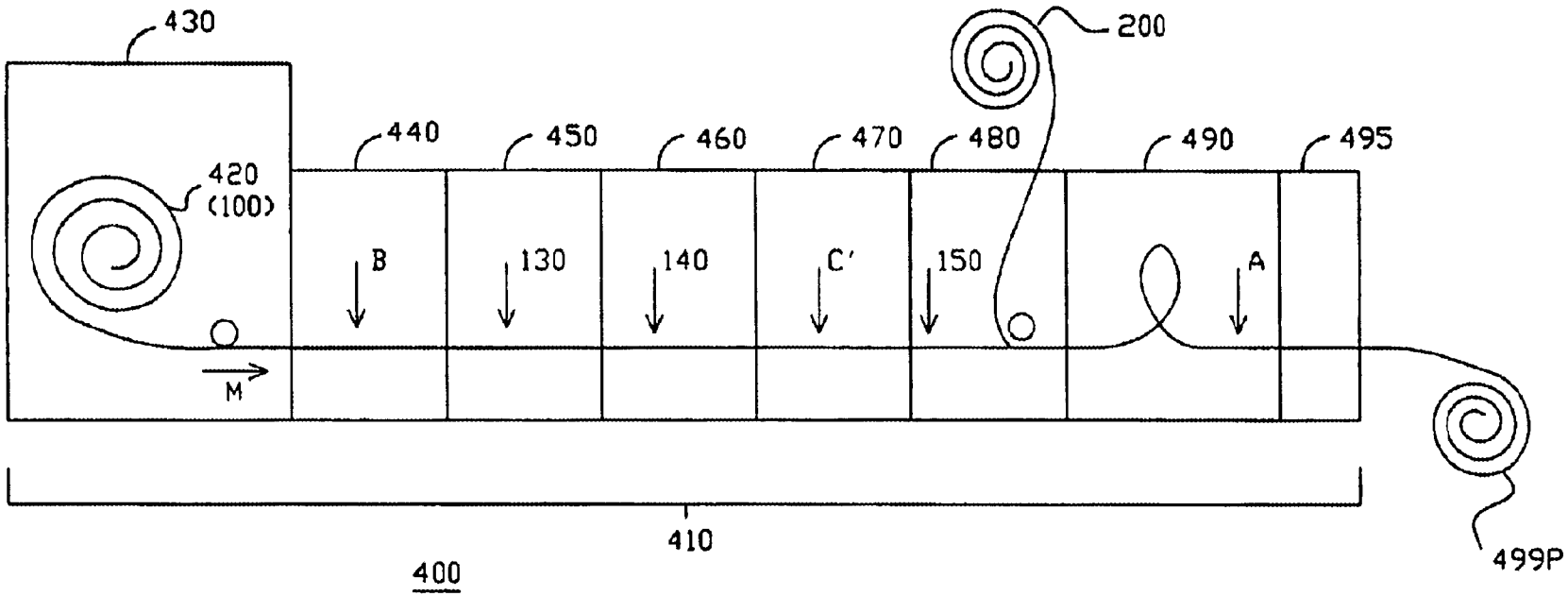
FIG. 4 is a schematic diagram of a manufacturing method of the present invention.

With attention, now, to FIG. 4, there depicted in schematic fashion is an exemplary in-line web press manufacturing installation 400 including multi-unit in-line printing and converting press 410, for mass production of label 10.

Multi-unit press 410 of installation 400 includes an unwind unit 430, a first printing unit 440, a first coating unit 450, a second coating unit 460, a second printing unit 470, a combination coating and converting unit 480, a web turning and printing unit 490, and a final converting unit 495, as will now each be further described in construction of a web of labels 10.

It is to be understood that press 410 is selectively capable of providing a variable number of print stations for application and drying of pigmented inks, coatings, and adhesives. As understood by those of ordinary skill in the printing arts, the exemplary multi-unit press 410 may be any suitable narrow- or wide-web press such as a flexographic, letterpress, gravure, screen, or offset press. Such presses are commercially available from, for example, Comco International of Milford, Ohio, or Mark Andy Inc. of St. Louis, Mo.

To begin the construction of labels 10, an unsupported film web 420 (comprising top ply 100 of FIG. 1) is preferably supplied in a conventional roll form to press 410 at unwind unit 430, and in a lengthwise machine direction M thereto. Film web 420 is commercially available from Applied Extrusion Technologies, Inc., of New castle, Del., and from UCB Films, Inc., of Robbinsdale, Minn. It is to be understood that any suitable in-line web material (whether an unsupported film, an unsupported paper base, or even a pressure sensitive adhesive laminate, for example) may be utilized for web 420.

Unwind unit 430 passes web 420 to first printing unit 440, where printed graphics B (as depicted in FIGS. 1–2) are sequentially printed on portions of back surface 120 of top ply 100 and web 420.

Web 420 bearing graphics B is then passed to first coating unit 450, where release coating 130 is applied to web 420 over graphics B. In like manner, web 420 passes to second coating unit 460, where breakaway coating 140 is applied to web 420 over release coating 130.

Web 420 bearing graphics B, release coating 130, and breakaway coating 140, then passes to second printing unit 470, where reverse image C is sequentially printed on breakaway coating 140.

Web 420 bearing graphics B, release coating 130, breakaway coating 140, and reverse image C, then passes to coating and converting unit 480. At unit 480, adhesive coating 150 is flood coated as aforedescribed. Release liner 200 is also preferably introduced to unit 480, whereupon web 420 is adhesively joined or "married" to release liner 200 by way of adhesive coating 150.

Adhesively married web 420 and liner 200 then pass to web turning and printing unit 490, where web 420 is turned over. The turning of web 420 may be provided by, for example, a turn-bar technique as is known in the art. After turning, printed graphics A are sequentially printed on turned web 420, to complete the printing and coating processes.

Figure 5:
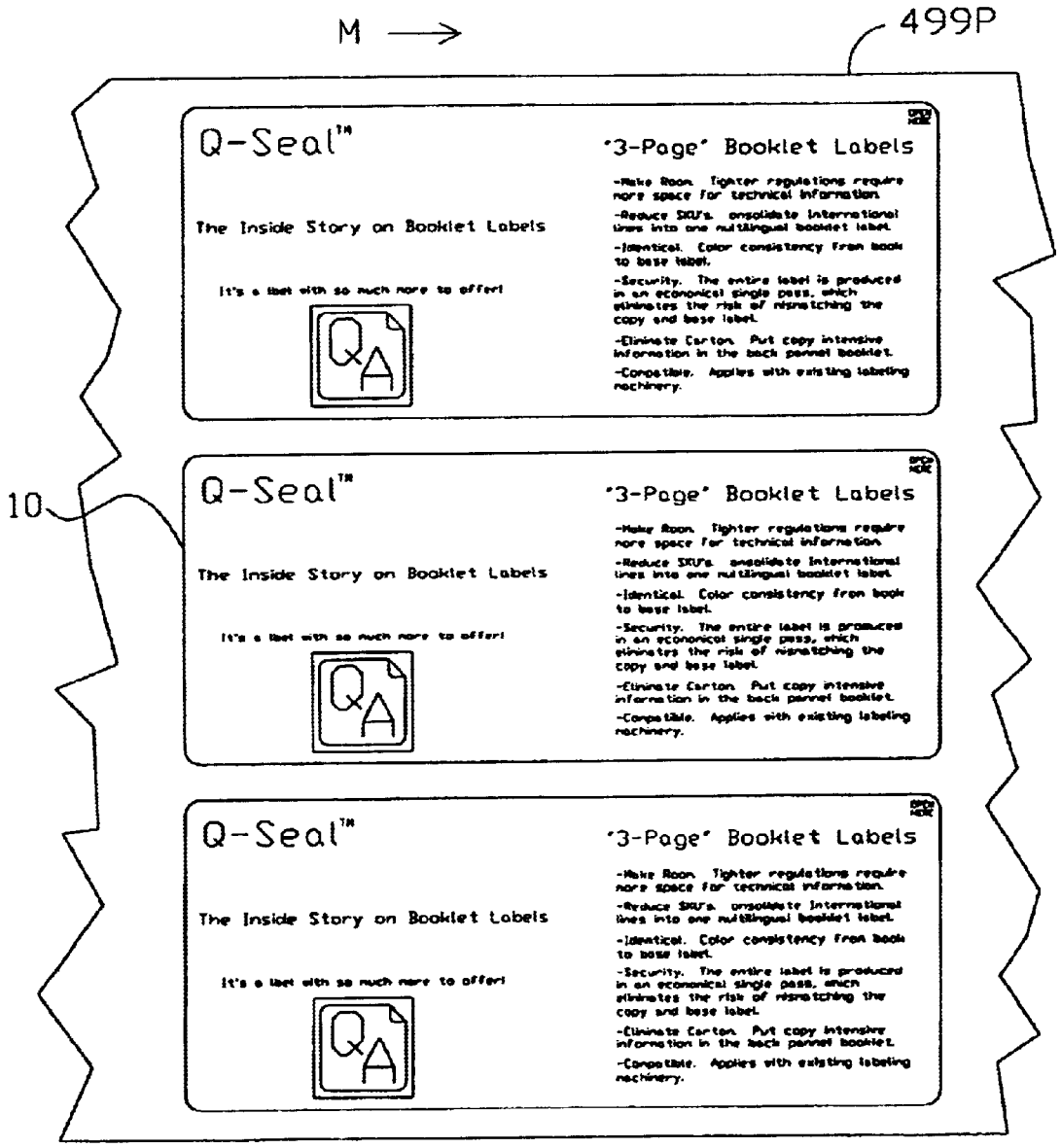
FIG. 5 is a front view illustration of a web of labels as individually shown in FIG. 1, produced in the method shown in FIG. 4.

Printed and coated web 420 then passes to final converting unit 495, where die cutting or other perforation techniques may be performed on web 420 for creation of individual labels 10 on printed and coated web 420 as shown in FIG. 5.

Finally, web 420 containing the individual labels 10 is re-wound into a supply roll as a finished product 499P, by way of any number of well-known methods for ease of customer handling thereof.

Alternatively, of course, web 420 containing the individual labels 10 could be processed into a stack of sheets (not illustrated) containing a series of individual labels.

While the present invention has been particularly shown and described with reference to the accompanying figures, it will be understood, however, that other modifications thereto are of course possible, all of which are intended to be within the true spirit and scope of the present invention. It should be appreciated that components of the invention aforedescribed may be substituted for other suitable components for achieving desired similar results, or that various accessories may be added thereto.

For instance, liner 200 could be obtained with adhesive 150 already coated thereon, thereby eliminating the coating step of unit 480 in exemplary press 410.

Also, label 10 could provide a so-called "thermage" label where top ply 100 functions as a disposable carrier for label 10. In such an embodiment relative to a product container, removal of top ply 100 (after application of label 10 to the container) results in identification/decoration on the container that has an appearance of being directly applied or screen printed thereon.

It is to be appreciated that any of the aforedescribed coatings and graphics may be selectively provided in any suitable combination on label 10, for a use thereof. For example, in FIG. 2, graphics B could be provided lengthwise across the entire label, for labeling a clear barrel, bottle, or like container.

It is to be understood that any suitable alternatives may be employed to provide the booklet-type adhesive image transfer label of the present invention, along with its manufacturing scheme.

Lastly, the choice, of course, of compositions, sizes, and strengths of various aforementioned components of booklet-type adhesive image transfer label 10 are all a matter of design choice depending upon intended uses of the present invention.

Accordingly, these and other various changes or modifications in form and detail of the present invention may also be made therein, again without departing from the true spirit and scope of the invention as defined by the appended claims.

What is claimed is:

1. A single ply three-surface repealable booklet-type label system including a transfer graphic image, comprising:

(a) a single ply having a front surface and a back surface, each of said front surface and said back surface being capable of receiving and selectively bearing printed graphic imagery thereon;

(b) a release coating applied over a selected transfer portion of said back surface of said single ply, with a portion of said back surface other than said selected transfer portion remaining as an uncoated hinge portion;

(c) a breakaway coating applied over said release coating in said transfer portion, said breakaway coating being capable of receiving and selectively bearing printed graphic imagery thereon;

(d) an adhesive coating applied over said hinge portion of said back surface of said single ply and over said breakaway coating and any graphic imagery on said transfer portion of said back surface of said single ply;

(e) a release liner applied to said adhesive coating for carrying said single ply label during the production and storage thereof and prior to application of said label to a surface to be labeled; and (f) wherein said adhesive coating transfers said breakaway coating and any graphic image thereon to a surface to be labeled as a transfer image, and said hinge portion of said back surface of said single ply adheres to said surface to be labeled forming a permanent hinge, and providing, with said transfer image, a permanent three-surface label selectively bearing graphic imagery on its surfaces.

2. A label system as in claim 1 wherein said release coating enables said transfer portion of said single ply, to which said release coating has been applied, to be selectively opened to expose any graphic imagery carried on said back surface of said single ply and any graphic imagery transferred to said surface to be labeled.

3. A label system as in claim 1 wherein at least said front surface of said single ply and said breakaway coating bear printed graphic imagery thereon.

4. A label system as in claim 2 wherein at least said front surface of said single ply and said breakaway coating bear printed graphic imagery thereon.

5. A label system as in claim 3 wherein said back surface of said single ply also bears printed graphic imagery.

6. A label system as in claim 4 wherein said back surface of said single ply also bears printed graphic imagery.

7. A label system as in claim 2 wherein said transfer portion of said single ply is resealable.

8. A label system as in claim 6 wherein said transfer portion of said single ply is resealable.

9. A label system as in claim 1 wherein said single ply is selected from the group consisting of paper, film, polypropylene, polyethylene, polyester, polyvinylchloride, polystyrene, foil, and ethylene vinyl acetate.

10. A label system as in claim 1 wherein said release coating is selected from the group consisting of water-based coatings, solvent-based coatings, ultraviolet light activated coatings, and hot melt coatings.

11. A label system as in claim 1 wherein said breakaway coating is selected from the group consisting of water-based coatings, solvent-based coatings, ultraviolet light activated coatings, and hot melt coatings.

12. A label system as in claim 1 wherein said adhesive coating is selected from the group consisting of water-based coatings, solvent-based coatings, ultraviolet light activated coatings, and hot melt coatings.

13. A single ply three-surface resealable booklet-type label system including a transfer graphic image comprising:

(a) a single ply having a front surface and a back surface, said front surface and said back surface each bearing printed graphic imagery thereon;

(b) a release coating applied over a selected transfer portion of said back surface of said single ply, with a portion other than said selected transfer portion of said back surface remaining as an uncoated hinge portion;

(c) a breakaway coating applied over said release coating in said transfer portion, said breakaway coating bearing printed graphic imagery thereon;

(d) an adhesive coating applied over said hinge portion of said back surface of said single ply and over said breakaway coating on said transfer portion of said back surface of said single ply;

(e) a release liner applied to said adhesive coating for carrying said single ply label during the production and storage thereof and prior to application of said label to a surface to be labeled; and (f) wherein said adhesive coating transfers said breakaway coating and said graphic imagery thereon to a surface to be labeled as a transfer image, and said hinge portion of said back surface of said single ply adheres to said surface to be labeled thereby forming a permanent hinge, and providing, with said transfer image, a permanent three-surface label bearing graphic imagery on each surface.

* * * * *

UNITED STATES PATENT AND TRADEMARK OFFICE

CERTIFICATE OF CORRECTION

PATENT NO. : 6,737,137 B2 
DATED : May 18, 2004
INVENTOR(S) : Joseph D. Franko, Sr. and Todd C. Wentz It is certified that error appears in the above-identified patent and that said Letters Patent is hereby corrected as shown below:

Column 3,
Line 1, "available Craig" should read -- available from Craig --;
Lines 9, 11 and 17, each occurrence of "C" should read -- C' --;
Line 12, "C'" should read -- C --;
Line 61, "C'" should read -- C/C' --;

Column 4,
Line 25, "New castle" should read -- New Castle --;
Lines 41 and 44, each occurrence of "C" should read -- C' --; and Column 5,
Line 44, "repealable" should read -- resealable --.

Signed and Sealed this

Ninth Day of November, 2004

JON W. DUDAS
*Director of the United States Patent and Trademark Office*